US010124462B2

(12) United States Patent
Kimba

(10) Patent No.: US 10,124,462 B2
(45) Date of Patent: Nov. 13, 2018

(54) POLISHING APPARATUS

(71) Applicant: EBARA CORPORATION, Tokyo (JP)

(72) Inventor: Toshifumi Kimba, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 185 days.

(21) Appl. No.: 15/170,645

(22) Filed: Jun. 1, 2016

(65) Prior Publication Data

US 2016/0354894 A1 Dec. 8, 2016

(30) Foreign Application Priority Data

Jun. 5, 2015 (JP) ..... 2015-114767

(51) Int. Cl.
*B24B 37/005* (2012.01)

(52) U.S. Cl.
CPC ..... *B24B 37/005* (2013.01)

(58) Field of Classification Search
CPC ..... B24B 37/005
See application file for complete search history.

(56) References Cited

U.S. PATENT DOCUMENTS 5,433,651 A * 7/1995 Lustig ..... B24B 37/013 216/88
6,120,349 A * 9/2000 Nyui ..... B24B 37/005 451/21
6,628,397 B1 * 9/2003 Nikoonahad ..... B24B 37/005 356/445
6,785,010 B2 * 8/2004 Kimba ..... B08B 1/04 356/630
7,675,634 B2 * 3/2010 Kimba ..... B08B 1/04 356/630
7,892,069 B2 * 2/2011 Na ..... B24B 37/345 451/460
8,535,115 B2 * 9/2013 David ..... B24B 37/013 356/614
9,248,544 B2 * 2/2016 Zhang ..... B24B 37/013
9,266,214 B2 * 2/2016 Kimba ..... B24B 37/013
(Continued)

FOREIGN PATENT DOCUMENTS

JP S54-014552 A 1/1979
JP 2001-105308 A 4/2001
(Continued)

OTHER PUBLICATIONS

Japan Patent Application No. 2015-114767; Reasons for Refusal; dated Dec. 5, 2017; 3 pages.

*Primary Examiner* — Marc Carlson
(74) *Attorney, Agent, or Firm* — Baker & Hostetler LLP

(57) ABSTRACT

A polishing apparatus capable of measuring a film thickness of a wafer using a plurality of optical sensors, without using an optical-path switching device for optical fibers, is disclosed. The polishing apparatus includes: an illuminating fiber having a plurality of distal ends arranged at different locations in a polishing table; a spectrometer configured to break up reflected light from a wafer in accordance with wavelength and measure an intensity of the reflected light at each of wavelengths; a light-receiving fiber having a plurality of distal ends arranged at the different locations in the polishing table; and a processor configured to generate a spectral waveform indicating a relationship between the intensity and wavelength of the reflected light and determine a film thickness based on the spectral waveform.

8 Claims, 13 Drawing Sheets

(56) References Cited

U.S. PATENT DOCUMENTS

| | | | | |
|---|---|---|---|---|
| 2009/0051939 | A1* | 2/2009 | Kimba | B08B 1/04 356/630 |
| 2012/0164917 | A1* | 6/2012 | Kobata | B24B 37/005 451/6 |
| 2012/0274932 | A1* | 11/2012 | David | B24B 37/013 356/300 |
| 2013/0109278 | A1* | 5/2013 | Kimba | B24B 49/04 451/5 |
| 2013/0224890 | A1* | 8/2013 | Xu | H01L 22/26 438/8 |
| 2014/0078495 | A1* | 3/2014 | Zhang | H01L 22/12 356/72 |
| 2014/0120802 | A1* | 5/2014 | Duescher | B24B 37/005 451/6 |
| 2014/0141695 | A1* | 5/2014 | David | B24B 37/04 451/11 |
| 2015/0228069 | A1* | 8/2015 | Fresquet | B24B 49/12 348/87 |
| 2015/0266159 | A1* | 9/2015 | Shiokawa | B24B 37/005 451/5 |

FOREIGN PATENT DOCUMENTS

| | | | |
|---|---|---|---|
| JP | 2001-141563 | A | 5/2001 |
| JP | 2001-235311 | A | 8/2001 |
| JP | 2003-168667 | A | 6/2003 |
| JP | 2009-510760 | A | 3/2009 |
| JP | 2010-023210 | A | 2/2010 |
| JP | 2012-138442 | A | 7/2012 |
| JP | 2013-110390 | A | 6/2013 |
| JP | 2014-504041 | A | 2/2014 |
| JP | 2014-216457 | A | 11/2014 |
| WO | WO 2007/061170 | A1 | 5/2007 |
| WO | WO 2012/102871 | A2 | 8/2012 |

* cited by examiner

Prior Art

Prior Art

POLISHING APPARATUS

CROSS REFERENCE TO RELATED APPLICATION

This document claims priority to Japanese Patent Application No. 2015-114767 filed Jun. 5, 2015, the entire contents of which are hereby incorporated by reference.

BACKGROUND

Semiconductor devices are manufactured through several processes including a process of polishing a dielectric film, e.g., $SiO_2$, and a process of polishing a metal film, e.g., copper or tungsten. Manufacturing processes of backside illumination CMOS sensor and through-silicon via (TSV) include a process of polishing a silicon layer (silicon wafer), in addition to the polishing processes of the dielectric film and the metal film. Polishing of the wafer is terminated when a thickness of a film (e.g., the dielectric film, the metal film, or the silicon layer), constituting a wafer surface, has reached a predetermined target value.

Polishing of a wafer is performed using a polishing apparatus. FIG. 13 is a schematic view showing an example of the polishing apparatus. The polishing apparatus typically includes a rotatable polishing table 202 for supporting a polishing pad 201, a polishing head 205 for pressing a wafer W against the polishing pad 201 on the polishing table 202, a polishing-liquid supply nozzle 206 for supplying a polishing liquid (or slurry) onto the polishing pad 201, and a film-thickness measuring device 210 for measuring a film thickness of the wafer W.

The film-thickness measuring device 210 shown in FIG. 13 is an optical film-thickness measuring device. This film-thickness measuring device 210 includes a light source 212 for emitting light, an illuminating optical fiber 215 coupled to the light source 212, a first optical fiber 216 and a second optical fiber 217 having distal ends disposed at different locations in the polishing table 202, a first optical-path switching device 220 for selectively coupling one of the first optical fiber 216 and the second optical fiber 217 to the illuminating optical fiber 215, a spectrometer 222 for measuring intensity of reflected light from the wafer W, a light-receiving optical fiber 224 coupled to the spectrometer 222, a third optical fiber 227 and a fourth optical fiber 228 having distal ends disposed at the different locations in the polishing table 202, and a second optical-path switching device 230 for selectively coupling one of the third optical fiber 227 and the fourth optical fiber 228 to the light-receiving optical fiber 224.

The distal end of the first optical fiber 216 and the distal end of the third optical fiber 227 constitute a first optical sensor 234, while the distal end of the second optical fiber 217 and the distal end of the fourth optical fiber 228 constitute a second optical sensor 235. The first optical sensor 234 and the second optical sensor 235 are arranged at different locations in the polishing table 202. As the polishing table 202 rotates, the first optical sensor 234 and the second optical sensor 235 move across the wafer W alternately. The first optical sensor 234 and the second optical sensor 235 direct the light to the wafer W, and receive the reflected light from the wafer W. The reflected light is transmitted through the third optical fiber 227 or the fourth optical fiber 228 to the light-receiving optical fiber 224, and is further transmitted through the light-receiving optical fiber 224 to the spectrometer 222. This spectrometer 222 breaks up the reflected light in accordance with wavelength and measures the intensity of the reflected light at each of wavelengths. A processor 240 is coupled to the spectrometer 222. This processor 240 generates a spectral waveform (or spectrum) from measured values of the intensity of the reflected light, and determines the film thickness of the wafer W from the spectral waveform.

FIG. 14 is a schematic view of the first optical-path switching device 220. The first optical-path switching device 220 has a piezoelectric actuator 244 for moving the distal ends of the first optical fiber 216 and the second optical fiber 217. When the piezoelectric actuator 244 moves the distal ends of the first optical fiber 216 and the second optical fiber 217, one of the first optical fiber 216 and the second optical fiber 217 is coupled to the illuminating optical fiber 215. Although not shown in the drawing, the second optical-path switching device 230 has the same structure.

The first optical-path switching device 220 and the second optical-path switching device 230 are configured to couple the first optical fiber 216 and the third optical fiber 227 to the illuminating optical fiber 215 and the light-receiving optical fiber 224, respectively, while the first optical sensor 234 is moving across the wafer W, and are further configured to couple the second optical fiber 217 and the fourth optical fiber 228 to the illuminating optical fiber 215 and the light-receiving optical fiber 224, respectively, while the second optical sensor 235 is moving across the wafer W. In this manner, the first optical-path switching device 220 and the second optical-path switching device 230 operate while the polishing table 202 is making one revolution. Therefore, the spectrometer 222 can separately process the reflected light received by the first optical sensor 234 and the reflected light received by the second optical sensor 235.

However, since the first optical-path switching device 220 and the second optical-path switching device 230 are mechanical switching devices, a malfunction may occur as a result of a long-time use. The occurrence of the malfunction in the first optical-path switching device 220 or the second optical-path switching device 230 may cause a change in the intensity of the reflected light transmitted from the first optical sensor 234 and the second optical sensor 235 to the spectrometer 222. As a result, the film thickness determined by the processor 240 may vary.

SUMMARY OF THE INVENTION

According to an embodiment, there is provided a polishing apparatus capable of measuring a film thickness of a wafer using a plurality of optical sensors, without using an optical-path switching device for optical fibers.

Embodiments, which will be described below, relate to a polishing apparatus for polishing a wafer having a film formed on a surface thereof, and more particularly to a polishing apparatus capable of detecting a film thickness of the wafer by analyzing optical information contained in a reflected light from the wafer.

In an embodiment, there is provided a polishing apparatus comprising: a polishing table for supporting a polishing pad; a polishing head configured to press a wafer against the polishing pad; a light source configured to emit light; an illuminating fiber having a plurality of distal ends arranged at different locations in the polishing table, the illuminating fiber being coupled to the light source to direct the light, emitted by the light source, to a surface of the wafer; a spectrometer configured to break up reflected light from the wafer in accordance with wavelength and measure an intensity of the reflected light at each of wavelengths; a light-receiving fiber having a plurality of distal ends arranged at the different locations in the polishing table, the light-receiving fiber being coupled to the spectrometer to direct the reflected light from the wafer to the spectrometer; and a processor configured to generate a spectral waveform indicating a relationship between the intensity and wavelength of the reflected light and determine a film thickness based on the spectral waveform.

In an embodiment, the illuminating fiber includes an illuminating trunk fiber, a first illuminating branch fiber, and a second illuminating branch fiber, the first illuminating branch fiber and the second illuminating branch fiber branching off from the illuminating trunk fiber, and the light-receiving fiber includes a light-receiving trunk fiber, a first light-receiving branch fiber, and a second light-receiving branch fiber, the first light-receiving branch fiber and the second light-receiving branch fiber branching off from the light-receiving trunk fiber.

In an embodiment, the plurality of distal ends of the illuminating fiber and the plurality of distal ends of the light-receiving fiber constitute a first optical sensor and a second optical sensor for directing the light to the wafer and receiving the reflected light from the wafer, and the second optical sensor is across a center of the polishing table from the first optical sensor.

In an embodiment, the polishing apparatus further comprises a calibration light source configured to emit light having a specified wavelength, the calibration light source being coupled to the spectrometer through a calibration optical fiber.

In an embodiment, the light source includes a first light source and a second light source.

In an embodiment, the first light source and the second light source are configured to emit light in a same wavelength range.

In an embodiment, the first light source and the second light source are configured to emit light in different wavelength ranges.

In an embodiment, the spectrometer includes a first spectrometer and a second spectrometer.

In an embodiment, the first spectrometer and the second spectrometer are configured to measure the intensity of the reflected light at different wavelength ranges.

In an embodiment, the processor is configured to perform a Fourier transform process on the spectral waveform to generate a frequency spectrum indicating a relationship between film thickness and strength of frequency component, determine a peak of the strength of frequency component which is greater than a threshold value, and determine the film thickness corresponding to the peak.

The reflected light from the wafer is directed to the spectrometer only when the distal ends of the illuminating fiber and the light-receiving fiber are present under the wafer. In other words, when the distal ends of the illuminating fiber and the light-receiving fiber are not present under the wafer, the intensity of the light directed to the spectrometer is very low. This means that light, other than the reflected light from the wafer, is not used to determine the film thickness. Accordingly, the film thickness can be determined with no light-path switching device.

DESCRIPTION OF EMBODIMENTS

Figure 1:
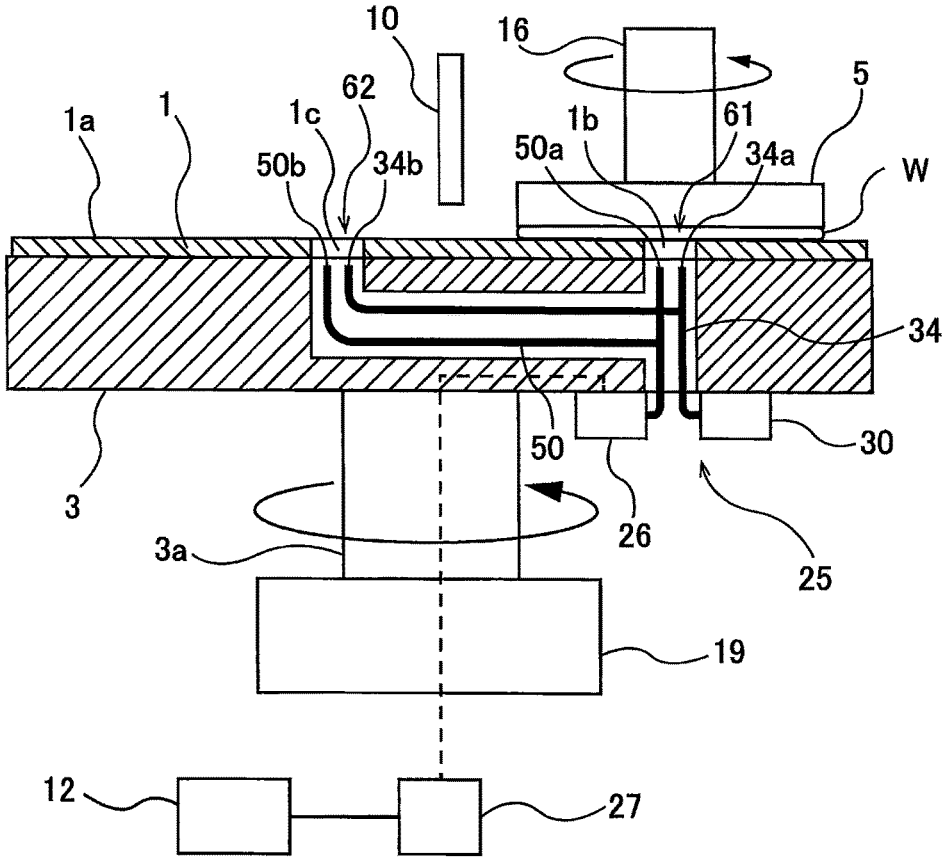
FIG. 1 is a view showing an embodiment of a polishing apparatus.

Embodiments will be described below with reference to the drawings. FIG. 1 is a view showing an embodiment of a polishing apparatus. As shown in FIG. 1, the polishing apparatus includes a polishing table 3 for supporting a polishing pad 1, a polishing head 5 for holding a wafer W and pressing the wafer W against the polishing pad 1 on the polishing table 3, a polishing-liquid supply nozzle 10 for supplying a polishing liquid (e.g., slurry) onto the polishing pad 1, and a polishing controller 12 for controlling polishing of the wafer W.

The polishing table 3 is coupled to a table motor 19 through a table shaft 3*a*, so that the polishing table 3 is rotated by the table motor 19 in a direction indicated by arrow. The table motor 19 is located below the polishing table 3. The polishing pad 1 is attached to an upper surface of the polishing table 3. The polishing pad 1 has an upper surface 1*a*, which provides a polishing surface for polishing the wafer W. The polishing head 5 is secured to a lower end of a polishing head shaft 16. The polishing head 5 is configured to be able to hold the wafer W on its lower surface by vacuum suction. The polishing head shaft 16 can be elevated and lowered by an elevating mechanism (not shown in the drawing).

Polishing of the wafer W is performed as follows. The polishing head 5 and the polishing table 3 are rotated in directions indicated by arrows, while the polishing liquid (or slurry) is supplied from the polishing-liquid supply nozzle 10 onto the polishing pad 1. In this state, the polishing head 5 presses the wafer W against the polishing surface 1*a* of the polishing pad 1. The surface of the wafer W is polished by a mechanical action of abrasive grains contained in the polishing liquid and a chemical action of the polishing liquid.

The polishing apparatus includes an optical film-thickness measuring device (i.e., a film-thickness measuring device) 25 for measuring a film thickness of the wafer W. This optical film-thickness measuring device 25 includes a light source 30 for emitting light, an illuminating fiber 34 having distal ends 34*a*, 34*b* arranged at different locations in the polishing table 3, a spectrometer 26 for breaking up reflected light from the wafer W and measuring an intensity of the reflected light at each of wavelengths, a light-receiving fiber 50 having distal ends 50*a*, 50*b* arranged at the different locations in the polishing table 3, and a processor 27 for generating a spectral waveform indicating a relationship between the intensity of the reflected light and the wavelength. The processor 27 is coupled to the polishing controller 12.

The illuminating fiber 34 is coupled to the light source 30 and is arranged so as to direct the light, emitted by the light source 30, to the surface of the wafer W. The light-receiving fiber 50 is coupled to the spectrometer 26 and is arranged so as to direct the reflected light from the wafer W to the spectrometer 26. The distal end 34*a* of the illuminating fiber 34 and the distal end 50*a* of the light-receiving fiber 50 are adjacent to each other. These distal ends 34*a*, 50*a* constitute a first optical sensor 61. The other distal end 34*b* of the illuminating fiber 34 and the other distal end 50*b* of the light-receiving fiber 50 are adjacent to each other. These distal ends 34*b*, 50*b* constitute a second optical sensor 62. The polishing pad 1 has through-holes 1*b*, 1*c* located above the first optical sensor 61 and the second optical sensor 62, respectively. The first optical sensor 61 and the second optical sensor 62 can transmit the light to the wafer W on the polishing pad 1 through the through-holes 1*b*, 1*c* and can receive the reflected light from the wafer W through the through-holes 1*b*, 1*c*.

Figure 2:
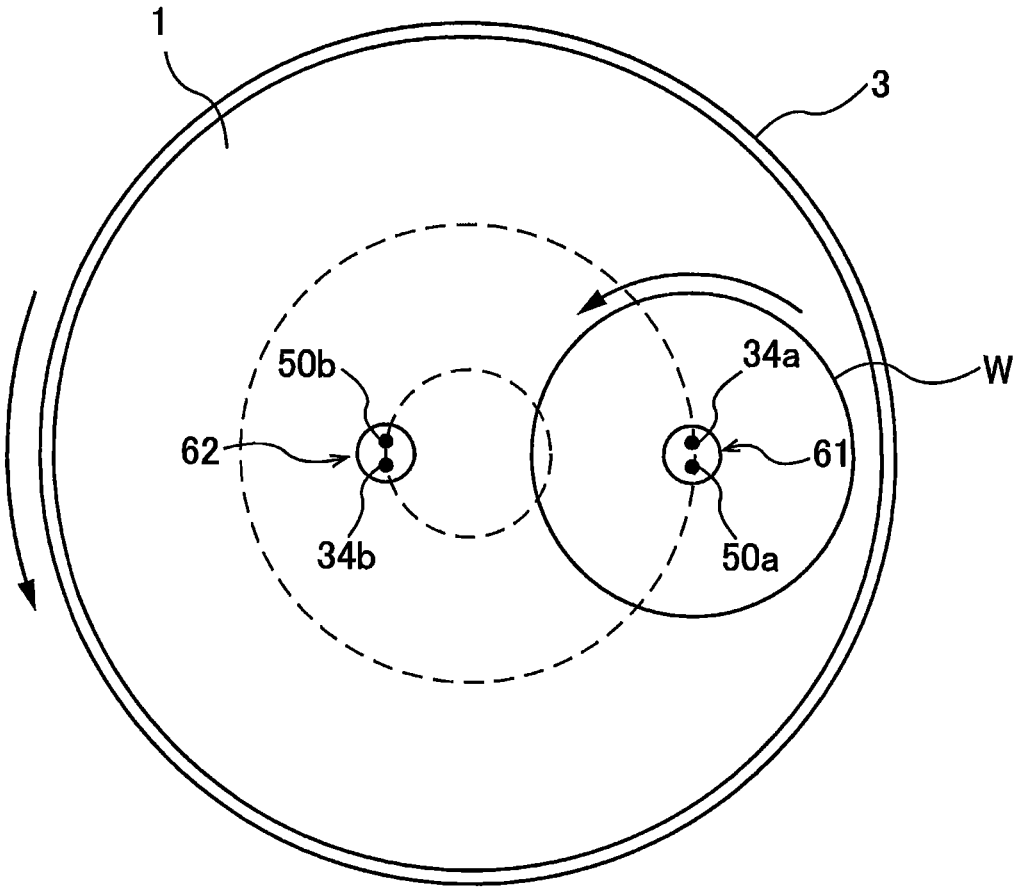
FIG. 2 is a plan view showing a polishing pad and a polishing table.

FIG. 2 is a plan view showing the polishing pad 1 and the polishing table 3. The first optical sensor 61 and the second optical sensor 62 are located at different distances from the center of the polishing table 3, and are arranged away from each other in the circumferential direction of the polishing pad 3. In the embodiment shown in FIG. 2, the second optical sensor 62 is across the center of the polishing table 3 from the first optical sensor 61. The first optical sensor 61 and the second optical sensor 62 move across the wafer W alternately in different paths each time the polishing table 3 makes one revolution. More specifically, the first optical sensor 61 sweeps across the center of the wafer W, while the second optical sensor 62 sweeps across only the edge portion of the wafer W. The first optical sensor 61 and the second optical sensor 62 direct the light to the wafer W alternately, and receive the reflected light from the wafer W alternately.

Figure 3:
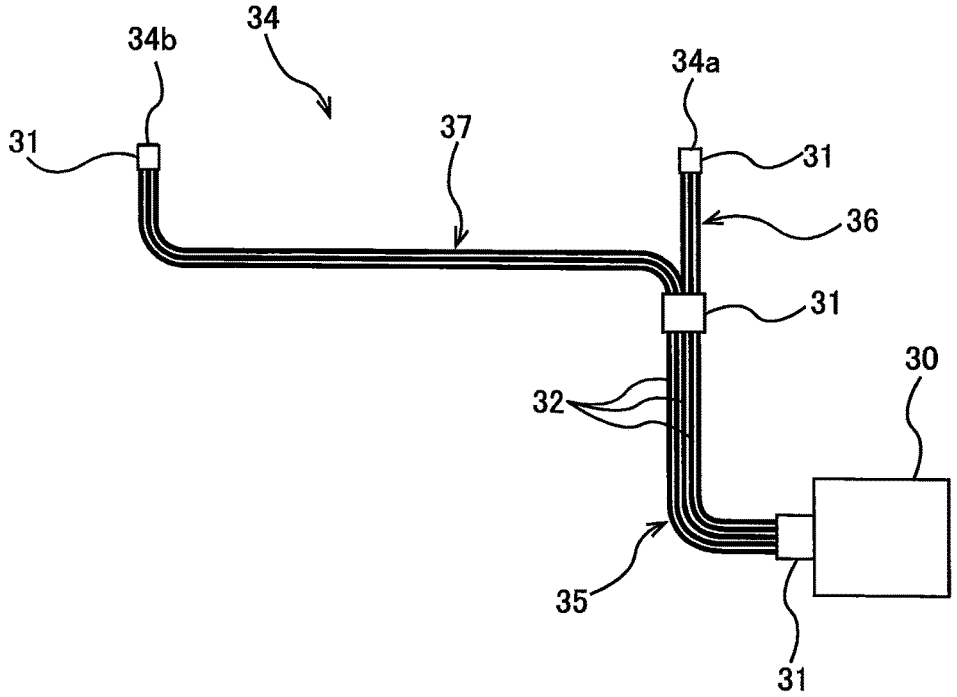
FIG. 3 is an enlarged view showing an illuminating fiber coupled to a light source.

FIG. 3 is an enlarged view showing the illuminating fiber 34 coupled to the light source 30. The illuminating fiber 34 comprises multiple strand optical fibers 32 bound by binding tools 31. The illuminating fiber 34 includes an illuminating trunk fiber 35, a first illuminating branch fiber 36, and a second illuminating branch fiber 37. The first illuminating branch fiber 36 and the second illuminating branch fiber 37 branch off from the illuminating trunk fiber 35.

Figure 4:
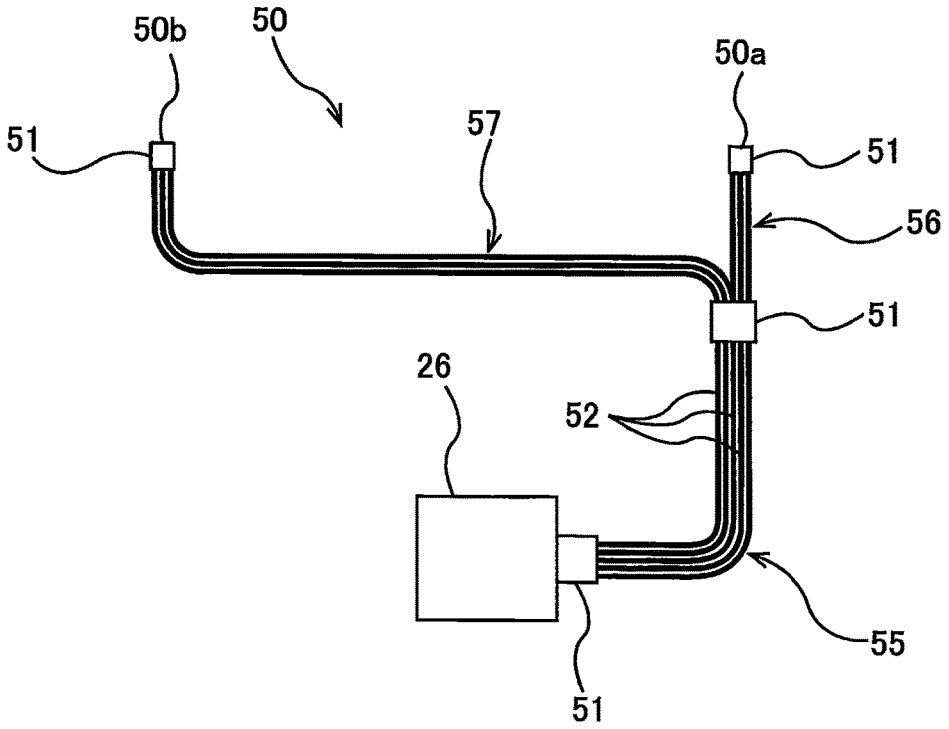
FIG. 4 is an enlarged view showing a light-receiving fiber coupled to a spectrometer.

FIG. 4 is an enlarged view showing the light-receiving fiber 50 coupled to the spectrometer 26. The light-receiving fiber 50 also comprises multiple strand optical fibers 52 bound by binding tools 51. The light-receiving fiber 50 includes a light-receiving trunk fiber 55, a first light-receiving branch fiber 56, and a second light-receiving branch fiber 57. The first light-receiving branch fiber 56 and the second light-receiving branch fiber 57 branch off from the light-receiving trunk fiber 55.

The distal ends 34*a*, 34*b* of the illuminating fiber 34 are constituted by distal ends of the first illuminating branch fiber 36 and the second illuminating branch fiber 37, respectively. These distal ends 34*a*, 34*b* are located in the polishing table 3, as described above. The distal ends 50*a*, 50*b* of the light-receiving fiber 50 are constituted by distal ends of the first light-receiving branch fiber 56 and the second light-receiving branch fiber 57, respectively. These distal ends 50*a*, 50*b* are also located in the polishing table 3.

In the embodiment shown in FIG. 3 and FIG. 4, the two branch fibers branch off from one trunk fiber. Three or more branch fibers can branch off by adding strand optical fibers. Moreover, a diameter of the fiber can be easily increased by adding strand optical fibers. Such a fiber constituted by multiple strand optical fibers has advantages that it can be easily bent and it is unlikely to snap.

During polishing of the wafer W, the illuminating fiber 34 directs the light to the wafer W, and the light-receiving fiber 50 receives the reflected light from the wafer W. The spectrometer 26 decomposes the reflected light in accordance with wavelength, measures the intensity of the reflected light at each of the wavelengths over a predetermined wavelength range, and transmits light intensity data obtained to the processor 27. This light intensity data is an optical signal reflecting a film thickness of the wafer W, and contains the intensities of the reflected light and the corresponding wavelengths. The processor 27 generates, from the light intensity data, the spectral waveform representing the intensity of the light at each of the wavelengths.

Figure 5:
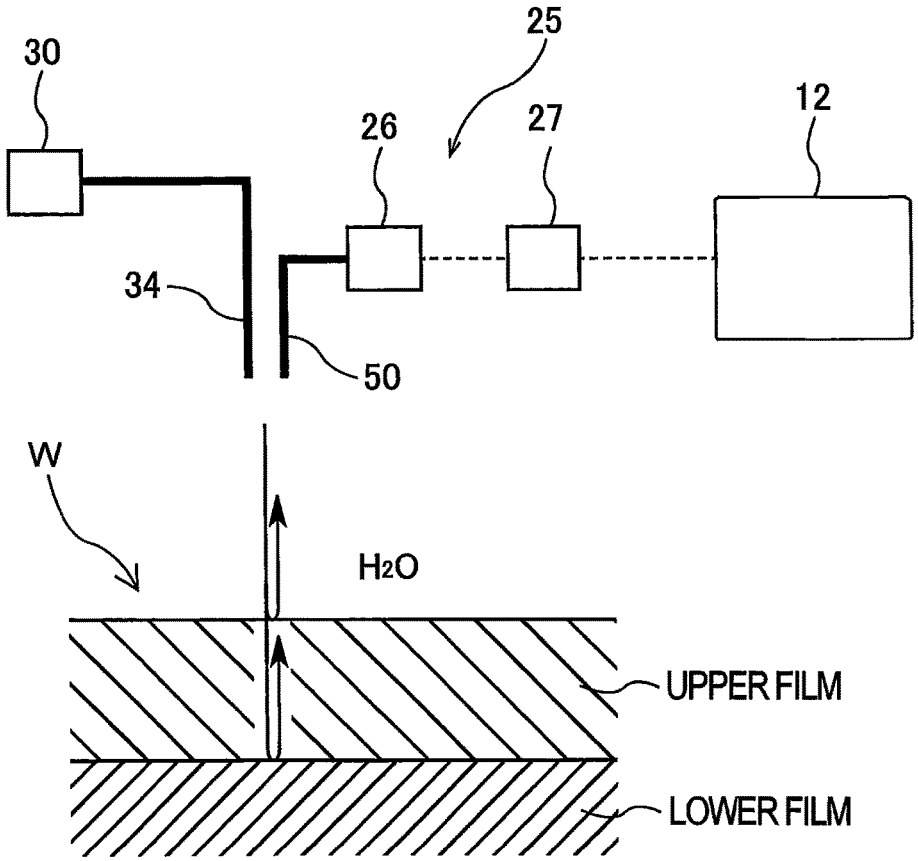
FIG. 5 is a schematic view illustrating the principle of an optical film-thickness measuring device.

FIG. 5 is a schematic view illustrating the principle of the optical film-thickness measuring device 25. In this example shown in FIG. 5, a wafer W has a lower film and an upper film formed on the lower film. The upper film is a film that can allow light to pass therethrough, such as a silicon layer or a dielectric film. The light, directed to the wafer W, is reflected off an interface between a medium (e.g., water in the example of FIG. 5) and the upper film and an interface between the upper film and the lower film. Light waves from these interfaces interfere with each other. The manner of interference between the light waves varies according to the thickness of the upper film (i.e., a length of an optical-path). As a result, the spectral waveform, produced from the reflected light from the wafer, varies according to the thickness of the upper film.

The spectrometer 26 breaks up the reflected light according to the wavelength and measures the intensity of the reflected light at each of the wavelengths. The processor 27 produces the spectral waveform from the reflected-light intensity data (or optical signal) obtained by the spectrometer 26. This spectral waveform is expressed as a line graph indicating a relationship between the wavelength and the intensity of the light. The intensity of the light can also be expressed as a relative value, such as a relative reflectance which will be discussed later.

Figure 6:
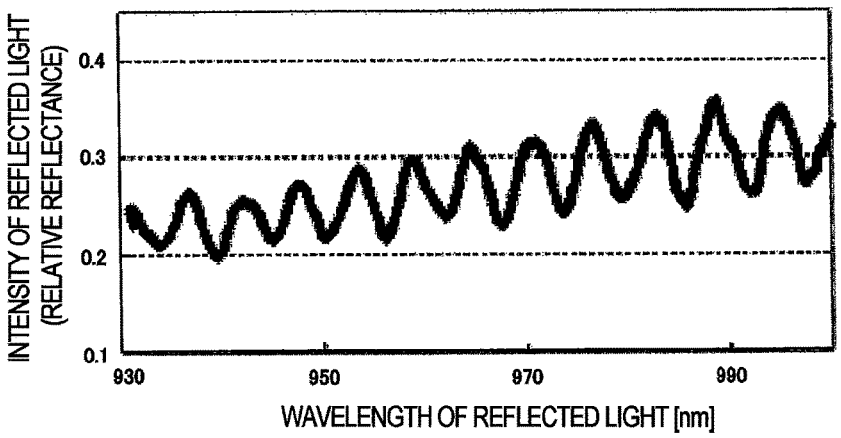
FIG. 6 is a graph showing an example of a spectral waveform.

FIG. 6 is a graph showing an example of the spectral waveform. In FIG. 6, vertical axis represents relative reflectance indicating the intensity of the reflected light from the wafer W, and horizontal axis represents wavelength of the reflected light. The relative reflectance is an index value that represents the intensity of the reflected light. The relative reflectance is a ratio of the intensity of the light to a predetermined reference intensity. By dividing the intensity of the light (i.e., the actually measured intensity) at each wavelength by a predetermined reference intensity, unwanted noises, such as a variation in the intensity inherent in an optical system or the light source of the apparatus, are removed from the actually measured intensity.

The reference intensity is an intensity that has been obtained in advance at each of the wavelengths. The relative reflectance is calculated at each of the wavelengths. Specifically, the relative reflectance is determined by dividing the intensity of the light (the actual intensity) at each wavelength by the corresponding reference intensity. The reference intensity is obtained by directly measuring the intensity of light emitted from a film-thickness sensor, or by irradiating a mirror with light from a film-thickness sensor and measuring the intensity of reflected light from the mirror. Alternatively, the reference intensity may be an intensity of the reflected light obtained when a silicon wafer (bare wafer) with no film thereon is being water-polished in the presence of water. In the actual polishing process, a dark level (which is a background intensity obtained under the condition that the light is cut off) is subtracted from the actually measured intensity to determine a corrected actually measured intensity. Further, the dark level is subtracted from the reference intensity to determine a corrected reference intensity. Then the relative reflectance is calculated by dividing the corrected actually measured intensity by the corrected reference intensity. That is, the relative reflectance $R(\lambda)$ can be calculated by using $$R(\lambda) = \frac{E(\lambda) - D(\lambda)}{B(\lambda) - D(\lambda)}$$

where $\lambda$ is wavelength, $E(\lambda)$ is the intensity of the light reflected from the wafer at the wavelength $\lambda$, $B(\lambda)$ is the reference intensity at the wavelength $\lambda$, and $D(\lambda)$ is the background intensity (i.e., dark level) at the wavelength $\lambda$, obtained under the condition that the light is cut off.

Figure 7:
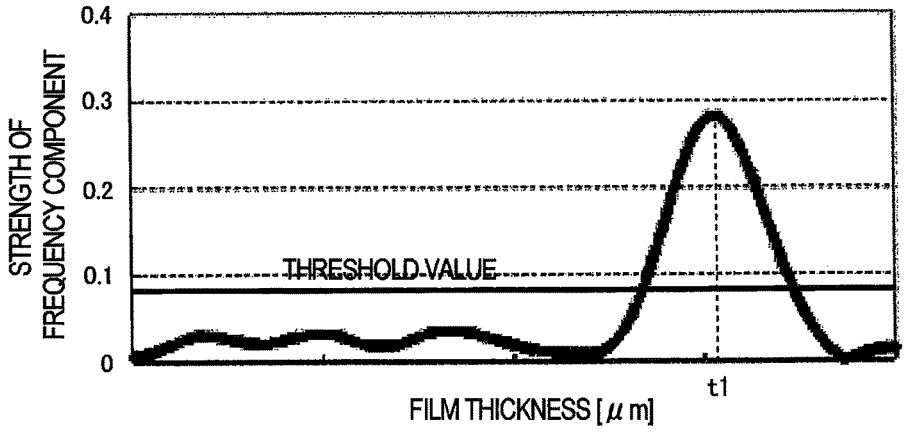
FIG. 7 is a graph showing a frequency spectrum obtained by performing Fourier transform process on the spectral waveform shown in FIG. 6.

The processor 27 performs a Fourier transform process (e.g., fast Fourier transform process) on the spectral waveform to generate a frequency spectrum and determines a film thickness of the wafer W from the frequency spectrum. FIG. 7 is a graph showing the frequency spectrum obtained by performing the Fourier transform process on the spectral waveform shown in FIG. 6. In FIG. 7, vertical axis represents strength of a frequency component contained in the spectral waveform, and horizontal axis represents film thickness. The strength of a frequency component corresponds to amplitude of a frequency component which is expressed as sine wave. A frequency component contained in the spectral waveform is converted into a film thickness with use of a predetermined relational expression, so that the frequency spectrum as shown in FIG. 7 is generated. This frequency spectrum represents a relationship between the film thickness and the strength of the frequency component. The above-mentioned predetermined relational expression is a linear function representing the film thickness and having the frequency component as variable. This linear function can be obtained from actual measurement results or an optical film-thickness measurement simulation.

In the graph shown in FIG. 7, a peak of the strength of the frequency component appears at a film thickness t1. In other words, the strength of the frequency component becomes maximum at the film thickness of t1. That is, this frequency spectrum indicates that the film thickness is t1. In this manner, the processor 27 determines the film thickness corresponding to a peak of the strength of the frequency component.

The processor 27 outputs the film thickness t1 as a film-thickness measurement value to the polishing controller 12. The polishing controller 12 controls polishing operations (e.g., a polishing terminating operation) based on the film thickness t1 sent from the processor 27. For example, if the film thickness t1 reaches a preset target value, the polishing controller 12 terminates polishing of the wafer W.

Figure 13:
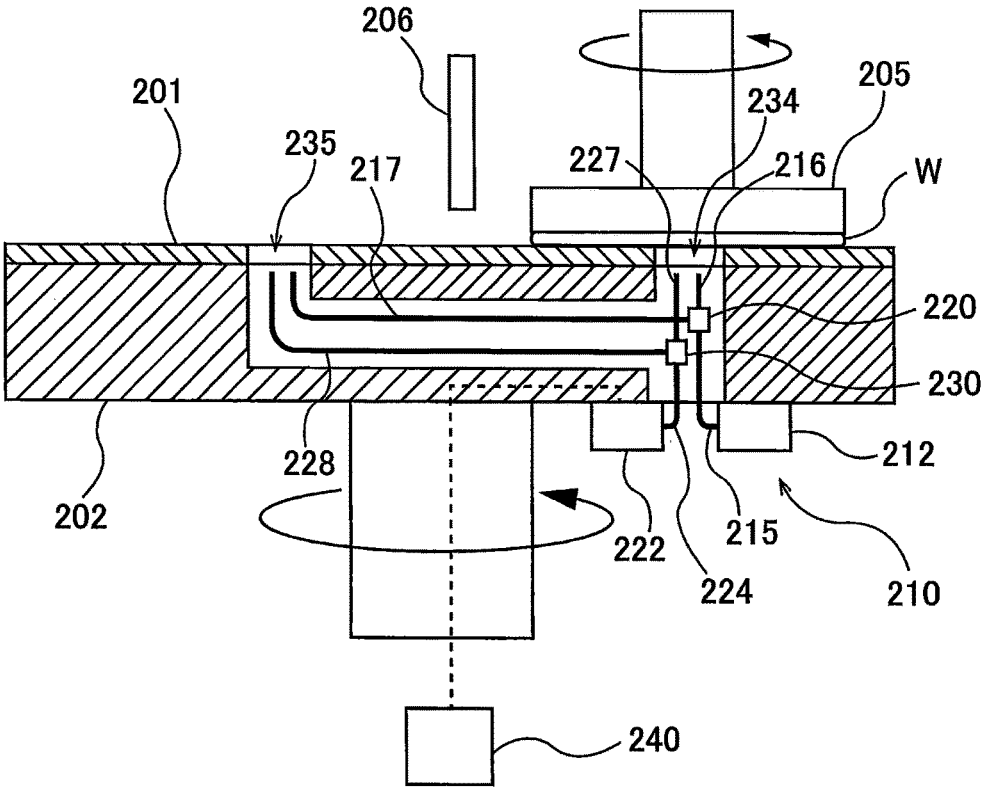
FIG. 13 is a schematic view showing an example of a polishing apparatus.
Figure 14:
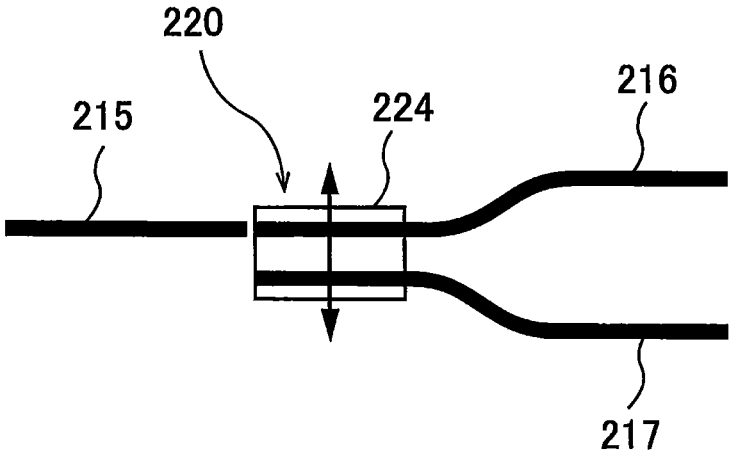
FIG. 14 is a schematic view of a first optical-path switching device shown in FIG. 13.

Unlike the film-thickness measuring device 210 shown in FIG. 13, the film-thickness measuring device 25 in this embodiment does not have any optical-path switching device for selectively connecting branch fibers to a trunk fiber. Specifically, the illuminating trunk fiber 35 is always connected to the first illuminating branch fiber 36 and the second illuminating branch fiber 37. Similarly, the light-receiving trunk fiber 55 is always connected to the first light-receiving branch fiber 56 and the second light-receiving branch fiber 57.

The second optical sensor 62 is located at the opposite side of the center of the polishing table 3 from the first optical sensor 61. Therefore, during polishing of the wafer W, the first optical sensor 61 and the second optical sensor 62 move across the wafer W alternately each time the polishing table 3 makes one revolution. The spectrometer 26 receives the light at all times through the first light-receiving branch fiber 56 and the second light-receiving branch fiber 57 of the light-receiving fiber 50. However, when the distal ends 34*a*, 34*b*, 50*a*, 50*b* of the illuminating fiber 34 and the light-receiving fiber 50 are not present under the wafer W, the intensity of the light received by the spectrometer 26 is very low. Thus, as shown in FIG. 7, in order to distinguish the reflected light coming from the wafer W from other light, the processor 27 stores therein a threshold value for the strength of the frequency component.

Figure 8:
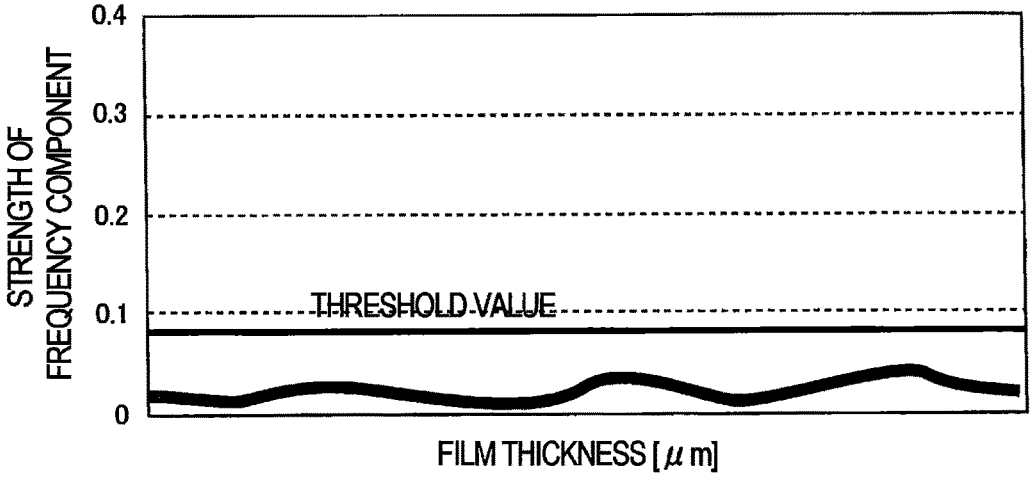
FIG. 8 is a graph showing a frequency spectrum generated when a distal end of the illuminating fiber and a distal end of the light-receiving optical fiber are not present under a wafer.

When the distal ends 34*a*, 34*b*, 50*a*, 50*b* of the illuminating fiber 34 and the light-receiving fiber 50 are not present under the wafer W, the intensity of the light entering the spectrometer 26 is low. At this time, the entirety of the strengths of the frequency components contained in the frequency spectrum becomes low. FIG. 8 is a graph showing the frequency spectrum generated when the distal ends of the illuminating fiber 34 and the distal ends of the light-receiving optical fiber 50 are not present under the wafer W. As shown in FIG. 8, the entirety of the strengths of the frequency components is lower than the threshold value. Accordingly, this frequency spectrum is not used for the film-thickness determination.

In contrast, as shown in FIG. 7, the frequency spectrum generated from the reflected light from the wafer W contains the strengths of the frequency components which are larger than the threshold value. The peak of the strength of the frequency component is larger than the threshold value. Accordingly, this frequency spectrum is used for the film-thickness determination.

In this manner, the processor 27 can distinguish the reflected light coming from the wafer W from other light by comparing the strength of the frequency component contained in the frequency spectrum with the threshold value. Moreover, because the first optical sensor 61 and the second optical sensor 62 move across the wafer W alternately, the reflected light received by the first optical sensor 61 and the reflected light received by the second optical sensor 62 are not superimposed on one another. Therefore, it is not necessary to provide an optical-path switching device. The film-thickness measuring process in the above-described embodiment can be performed not only during polishing of the wafer W, but also before and/or after polishing of the wafer W.

Figure 9:
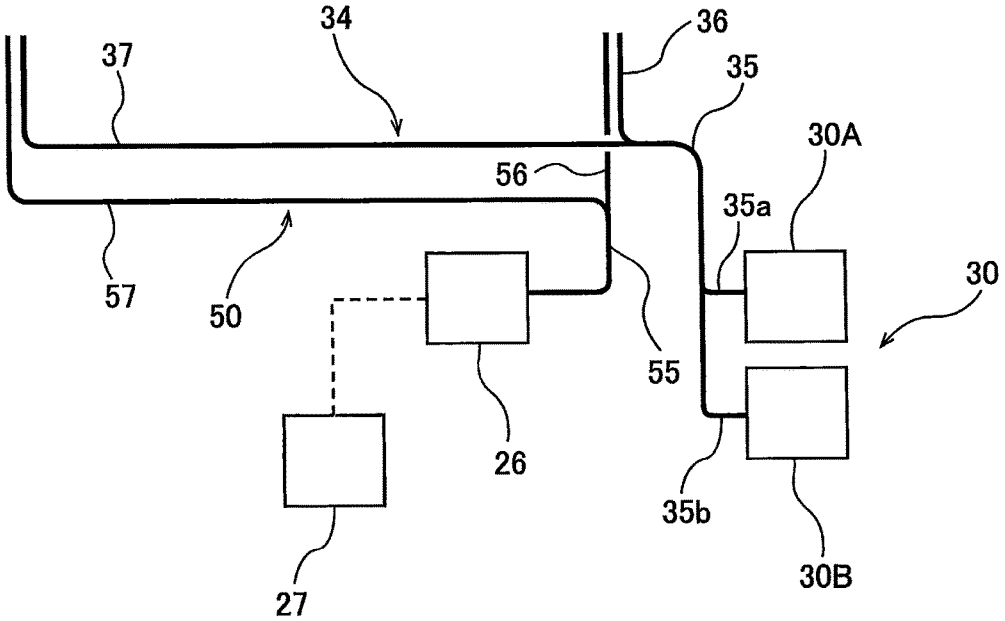
FIG. 9 is a schematic view showing an embodiment in which a first light source and a second light source are provided.

FIG. 9 is a schematic view showing an embodiment in which a first light source 30A and a second light source 30B are provided. As shown in FIG. 9, the light source 30 is constituted by the first light source 30A and the second light source 30B. The illuminating fiber 34 is coupled to both the first light source 30A and the second light source 30B. Specifically, the illuminating trunk fiber 35 has two input terminal lines 35*a*, 35*b*, which are coupled to the first light source 30A and the second light source 30B, respectively.

The first light source 30A and the second light source 30B may be light sources having different structures. For example, the first light source 30A is a halogen lamp, while the second light source 30B is a light-emitting diode. The halogen lamp can emit light with a wide wavelength range (e.g., 300 nm to 1300 nm) and has a short service life (e.g., about 2000 hours), while the light-emitting diode can emit light with a narrow wavelength range (e.g., 900 nm to 1000 nm) and has a long service life (e.g., about 10000 hours). According to this embodiment, either the first light source 30A or the second light source 30B can be selected appropriately based on a type of the film of the wafer W. Other type of light source, such as xenon lamp, deuterium lamp, or laser, may be used.

The first light source 30A and the second light source 30B may be light sources having the same structure which can emit light in the same wavelength range. For example, a halogen lamp may be used for both the first light source 30A and the second light source 30B. The halogen lamp has a relatively short service life of, e.g., about 2000 hours. According to this embodiment, the service life of the film-thickness measuring device 25 can be increased by switching to the second light source 30B if a quantity of light emitted by the first light source 30A is lowered. Further, if a quantity of light emitted by the second light source 30B is also lowered, both of the first light source 30A and the second light source 30B are replaced with new ones. According to this embodiment, a double service life can be achieved with one replacement operation. As a result, it is possible to reduce a time required for the polishing apparatus to stop its operations.

Figure 10:
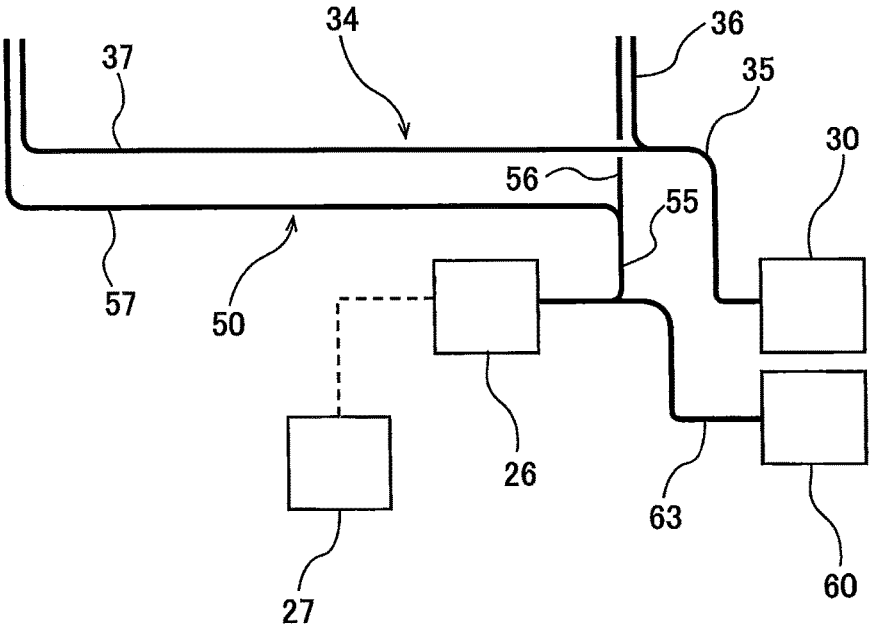
FIG. 10 is a schematic view showing an embodiment in which a calibration light source for emitting light having a specified wavelength is provided in addition to the light source.

FIG. 10 is a schematic view showing an embodiment in which a calibration light source 60 for emitting light having a specified wavelength is provided, in addition to the light source 30. The calibration light source 60 is coupled to the spectrometer 26 through a calibration optical fiber 63. This calibration optical fiber 63 may be a part of the light-receiving fiber 50. Specifically, the calibration optical fiber 63 may be a third light-receiving branch fiber branching off from the light-receiving trunk fiber 55.

The calibration light source 60 may be a discharge light source for emitting light with a high intensity at a specified wavelength, such as xenon lamp. The light emitted from the calibration light source 60 is broken up by the spectrometer 26, and a spectral waveform is generated by the processor 27. Because the light emitted by the calibration light source 60 has the specified wavelength, the spectral waveform is generated as a bright-line spectrum. The wavelength of the light of the calibration light source 60 is known. Accordingly, the spectrometer 26 is calibrated such that a wavelength of a bright line contained in the bright-line spectrum coincides with the wavelength of the light of the calibration light source 60.

In order for a film-thickness measuring device to measure an accurate film thickness, it is necessary to adjust a spectrometer regularly or irregularly. A conventional calibration method is to place a calibration light source on a polishing pad to irradiate a first optical sensor or a second optical sensor with light, and measure the intensity of the light by a spectrometer. However, such a conventional calibration method entails stoppage of the operation of the polishing apparatus. Moreover, a polishing surface of the polishing pad may be contaminated. According to the above-described embodiment, the calibration light source 60 is disposed in the polishing table 3 and is coupled to the spectrometer 26. Therefore, the calibration of the spectrometer 26 can be conducted without stopping the operation of the polishing apparatus. For example, the calibration of the spectrometer 26 may be conducted during polishing of the wafer W.

Figure 11:
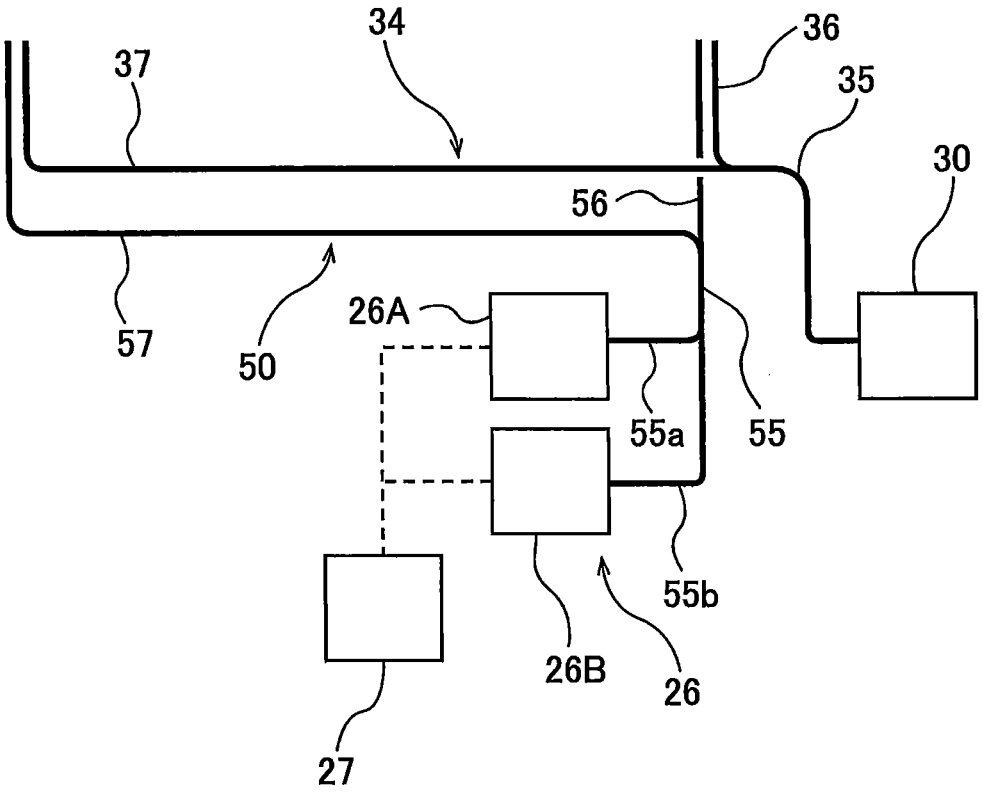
FIG. 11 is a schematic view showing an embodiment in which a first spectrometer and a second spectrometer are provided.

FIG. 11 is a schematic view showing an embodiment in which a first spectrometer 26A and a second spectrometer 26B are provided. As shown in FIG. 11, the spectrometer 26 of this embodiment is constituted by the first spectrometer 26A and the second spectrometer 26B. The light-receiving fiber 50 is coupled to both the first spectrometer 26A and the second spectrometer 26B. Specifically, the light-receiving trunk fiber 55 has two output terminal lines 55*a*, 55*b*, which are coupled to the first spectrometer 26A and the second spectrometer 26B, respectively. Both of the first spectrometer 26A and the second spectrometer 26B are coupled to the processor 27.

The first spectrometer 26A and the second spectrometer 26B are configured to measure the intensity of the reflected light at different wavelength ranges. For example, the first spectrometer 26A is configured to be able to measure light within a wavelength range of 400 nm to 800 nm, and the second spectrometer 26B is configured to be able to measure light within a wavelength range of 800 nm to 1100 nm. The light source 30 may be a halogen lamp (which can emit light having wavelengths of 300 nm to 1300 nm). The processor 27 generates a spectral waveform from optical intensity data transmitted from the first spectrometer 26A and the second spectrometer 26B. The optical intensity data is an optical signal containing the intensities of the reflected light and corresponding wavelengths. Further, the processor 27 performs the Fourier transformation on the spectral waveform to generate a frequency spectrum. The optical film-thickness measuring device 25 having the two spectrometers 26A, 26B can achieve a higher resolution than that of a single spectrometer which can measure light having wavelengths in a range of 400 nm to 1100 nm.

The first spectrometer 26A and the second spectrometer 26B may have different structures. For example, the second spectrometer 26B may be constituted by a photodiode. In this case, the processor 27 generates a spectral waveform from optical intensity data (i.e., an optical signal containing the intensities of the reflected light and corresponding wavelengths) transmitted from the first spectrometer 26A, and generates a frequency spectrum by, for example, performing the Fourier transformation on the spectral waveform.

The second spectrometer 26B, which is constituted by a photodiode, is used to detect the presence of water. The light source 30 may be a halogen lamp (which can emit light having wavelengths of 300 nm to 1300 nm). The photodiode can typically measure light having wavelengths in a range of 900 nm to 1600 nm. If water exists between the wafer W and the distal ends of the fibers 34, 50, the intensity of the reflected light is lowered at wavelengths of around 1000 nm. The processor 27 can detect the presence of the water based on the decrease in the intensity of the reflected light at wavelengths of around 1000 nm.

Figure 12:
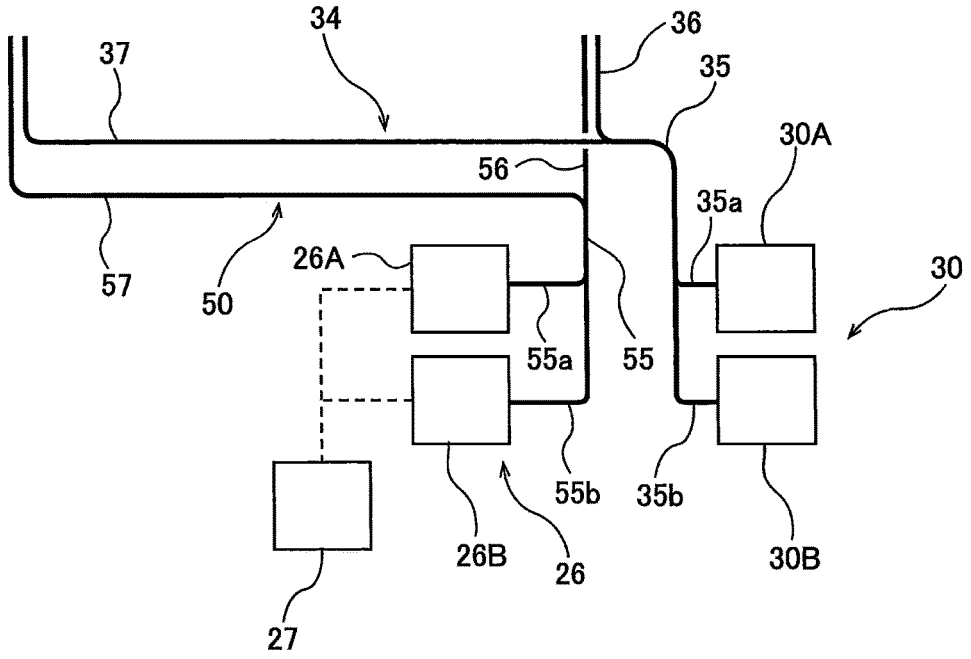
FIG. 12 is a schematic view showing an embodiment in which a first light source, a second light source, a first spectrometer, and a second spectrometer are provided.

The above-discussed embodiments can be combined appropriately. For example, as shown in FIG. 12, the first light source 30A and the second light source 30B, and the first spectrometer 26A and the second spectrometer 26B may be provided. More specifically, the first light source 30A may be a halogen lamp, the second light source 30B may be a light-emitting diode, and the second spectrometer 26B may be a photodiode.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus for polishing a wafer while measuring a film thickness of the wafer, comprising:

a polishing table for supporting a polishing pad;

a polishing head configured to press a wafer against the polishing pad;

a light source configured to emit light;

an illuminating fiber having a plurality of distal ends arranged at different locations in the polishing table, the illuminating fiber being coupled to the light source to direct the light, emitted by the light source, to a surface of the wafer;

a first spectrometer and a second spectrometer each configured to break up reflected light from the wafer in accordance with wavelength and measure an intensity of the reflected light at each of wavelengths, the first spectrometer and the second spectrometer being configured to measure the intensity of the reflected light at different wavelength ranges;

a light-receiving fiber having a plurality of distal ends arranged at the different locations in the polishing table, the light-receiving fiber being coupled to the first spectrometer and the second spectrometer to direct the reflected light from the wafer to the first spectrometer and the second spectrometer, the plurality of distal ends of the illuminating fiber and the plurality of distal ends of the light-receiving fiber constituting a first optical sensor and a second optical sensor each configured to direct the light to the wafer and receive the reflected light from the wafer, each of the first optical sensor and the second optical sensor being coupled to both the first spectrometer and the second spectrometer; and a processor configured to generate a spectral waveform indicating a relationship between the intensity and wavelength of the reflected light and determine a film thickness based on the spectral waveform.

2. The polishing apparatus according to claim 1, wherein:

the illuminating fiber includes an illuminating trunk fiber, a first illuminating branch fiber, and a second illuminating branch fiber, the first illuminating branch fiber and the second illuminating branch fiber branching off from the illuminating trunk fiber; and the light-receiving fiber includes a light-receiving trunk fiber, a first light-receiving branch fiber, and a second light-receiving branch fiber, the light-receiving trunk fiber being coupled to the first spectrometer and the second spectrometer, the first light-receiving branch fiber and the second light-receiving branch fiber branching off from the light-receiving trunk fiber.

3. The polishing apparatus according to claim 1, wherein the second optical sensor is across a center of the polishing table from the first optical sensor.

4. The polishing apparatus according to claim 1, further comprising:

a calibration light source configured to emit light having a specified wavelength, the calibration light source being coupled to at least one of the first spectrometer and the second spectrometer through a calibration optical fiber.

5. The polishing apparatus according to claim 1, wherein the processor is configured to perform a Fourier transform process on the spectral waveform to generate a frequency spectrum indicating a relationship between film thickness and strength of frequency component, determine a peak of the strength of frequency component which is greater than a threshold value, and determine the film thickness corresponding to the peak.

6. The polishing apparatus according to claim 1, wherein the light source includes a first light source and a second light source.

7. The polishing apparatus according to claim 6, wherein the first light source and the second light source are configured to emit light in a same wavelength range.

8. The polishing apparatus according to claim 6, wherein the first light source and the second light source are configured to emit light in different wavelength ranges.

* * * * *